US005285973A

United States Patent [19]

Goforth et al.

[11] Patent Number: 5,285,973

[45] Date of Patent: Feb. 15, 1994

[54] CLOSE TOLERANCE SHREDDER

[75] Inventors: Billy D. Goforth, Fayetteville; Charles L. Goforth, Lowell; Joe G. Brooks; J. Douglas Brooks, both of Springdale, all of Ark.

[73] Assignee: Advanced Environmental Recycling Technologies, Inc., Springdale, Ark.

[21] Appl. No.: 914,155

[22] Filed: Jul. 15, 1992

[51] Int. Cl.[5] ..... B02C 4/32

[52] U.S. Cl. ..... 241/36; 241/236

[58] Field of Search ..... 241/35, 36, 41, 31, 241/224, 236, DIG. 38

[56] References Cited

U.S. PATENT DOCUMENTS

| | | | |
|---|---|---|---|
| 3,843,060 | 10/1974 | Colburn | 241/24 |
| 3,868,062 | 2/1975 | Cunningham et al. | 241/36 |
| 3,991,944 | 11/1976 | Baikoff | 241/36 |
| 4,162,768 | 7/1979 | Froats | 241/45 |
| 4,378,851 | 4/1983 | deVries | 241/31 X |
| 4,629,134 | 12/1986 | Pennekamp | 241/236 X |
| 4,721,257 | 1/1988 | Williams et al. | 241/236 X |

FOREIGN PATENT DOCUMENTS 695881 10/1964 Canada .

*Primary Examiner*—Douglas D. Watts

*Attorney, Agent, or Firm*—Ross, Howison, Clapp & Korn

[57] ABSTRACT

A shredder including a shredder housing having an inside, an outside, side walls, end walls, such that the end walls and side walls are engineered and joined together to maintain tight tolerance within the shredder. The end walls and side walls define a top inlet opening and a bottom outlet opening. Two parallel spaced apart shafts are horizontally aligned with each other and rotationally mounted through the end walls for receiving rotational power. Adjustable speed rotational motors engage each of the shafts for rotating them in counter-rotational directions. A plurality of uniform thickness disk-shaped blades are alternatingly positioned with interposed disk-shaped spacers placed therebetween. The spacers have a thickness slightly thicker than the blades. The blades and spacers are arranged on the shafts and mounted for counter-rotation with the shafts in an interdigitated fashion so that the blades on one of the shafts are aligned with the spacers on the other shaft such that the blades pass side-by-side closely spaced with the blades on the counter-rotating shafts so that close tolerance cutting occurs between the blades.

12 Claims, 4 Drawing Sheets

CLOSE TOLERANCE SHREDDER

TECHNICAL FIELD OF THE INVENTION

The present invention relates to a shredder and in particular, to a shredder having counter-rotating shafts with multiple close tolerance shredding blades which mesh in interdigitated fashion in a housing having adjustable and replaceable side support bearings.

BACKGROUND OF THE INVENTION

In connection with the manufacture and/or recycling of polymeric materials, such as rubber, plastic, and the like, shredders and grinders have been used which employ rotating or whirling blades to cut, shred, and tear the polymeric material fed into a housing containing the blades. In the past, however, these devices have had substantial clearance between one blade and another and between the blades and the housing. Typically, the blades were thin, having a thickness less than about one-half of an inch (about 1.3 cm). Operation of such devices depended upon the thickness and momentum of the rubber or plastic material and the impact speed and the sharpness of the blades to cut, chip, and shred the polymeric materials into smaller piece sizes. Such devices have been inadequate for the purpose of shredding certain types of plastic for a number of reasons, especially in the case of thin-gauge plastic film. The throughput is limited. The plastic material rather than being cut or shredded, is often torn or merely stretched and pulled through the space between the blades. Plastic film often wraps itself around the rotating shafts in string fashion and clogs the throughput of the shredder. The tearing, stretching, and clogging also wears and dulls the blades and further reduces cutting or shredding efficiency. In the case of rotating parallel shafts having blades on them, the plastic material drawn between the shafts results in a high pressure wedging therebetween, which tends to cause the shafts to spread. The plastic thus passes through the machine without cutting. A sufficient buildup of woundup plastic sheet can result, causing friction within the machine, excessive heat buildup, and subsequent meltdown of the plastic material. Removal of the melted plastic requires complete shutdown and disassembly of the apparatus.

Some known plastic cutting machines which might be adapted for shredding plastic include a solid tub-shaped housing in which rotary blades operate. Maintenance and access to the interior of the housing requires that all of the blades be loosened from the shaft and that the shafts be withdrawn axially through an end of the housing. Thus, if meltdown occurs, if plastic clogging occurs, or if other foreign materials such as metals, wire, and the like are ingested into the machine, a time-consuming and costly and inefficient repair process must be implemented. In a continuous production line, shutdown of a single shredding machine can result in a shutdown of the entire production line, thereby multiplying the cost of the repairs significantly.

SUMMARY OF THE INVENTION

The present invention overcomes significant disadvantages of prior known plastic cutting machines adapted for shredding plastic by providing a high throughput counter-rotating shredder having closely spaced interdigitated shredder blades. The terms "co-rotating" and "counter-rotating" are sometimes used to convey the same idea that parallel shafts move down or both move up between them—hence, co-rotating. This also means that one shaft rotates counterclockwise and the other rotates clockwise—hence, counter-rotating. Throughout this application, this action will be referred to as "counter-rotating." The blades are assembled and constructed to provide multiple close tolerance cutting edge interfaces, including cutting interfaces circumferentially between each blade and the interior surface of the housing, cutting interfaces between each blade and an opposed circular bearing surface, cutting interfaces between sides of opposed counter-rotating blades and cutting interfaces between the blades and side support bearing brackets.

There are a plurality of blades which, when stacked together, have a substantial thickness and are mounted on parallel shafts. The parallel shafts are driven with independent variable speed motors so that the rotational speed of one shaft with respect to the other can be adjusted. The shafts are mounted for rotation through opposite ends of the housing and are further supported with diametrically opposed adjustable side bearings which are mounted on either side of the housing to maintain close tolerance at the cutting interfaces and to prevent spreading even under extreme high pressures between the shafts.

According to another feature of the unique construction, the interior of the housing can be accessed through removable side plates. The entire shafts need not be removed. This allows dislodging plastic clogs and foreign materials which cause jamming in an efficient and time-saving operation. It also allows the side bearings to be conveniently replaced.

According to another feature, the motors are provided with a torque sensing control system which senses excessive torque due to overloading, clogging, or jamming by foreign material. Upon sensing such excessive torque, the blades are automatically turned in reverse for a short period of time to dislodge the clog and then automatically restarted in the shredding direction. The automatic reversal and restart action can be programmed for a predetermined number of attempts to remove the clog. For example, the machine may respond to a sensed high pressure three separate times within a given short time span before the machine is shut down completely and the operator is signalled to provide maintenance. As indicated above, the maintenance may be as simple as removing one or both of the side plates to manually dislodge the foreign material or the clog inside of the housing. In this manner, the shutdown time is minimized to only those instances in which reverse turning of the blades will not dislodge or overcome the blockage which was detected as excessive motor torque. Hydraulic motors are further advantageously used so that the excessive torque is easily detectable using hydraulic pressure sensors.

BRIEF DESCRIPTION OF THE DRAWINGS

The foregoing objects, advantages, and features, as well as other objects and advantages will become more apparent with reference to the description and drawings below, in which like elements represent like numerals and in which.

DETAILED DESCRIPTION OF THE PREFERRED EMBODIMENT

Figure 2:
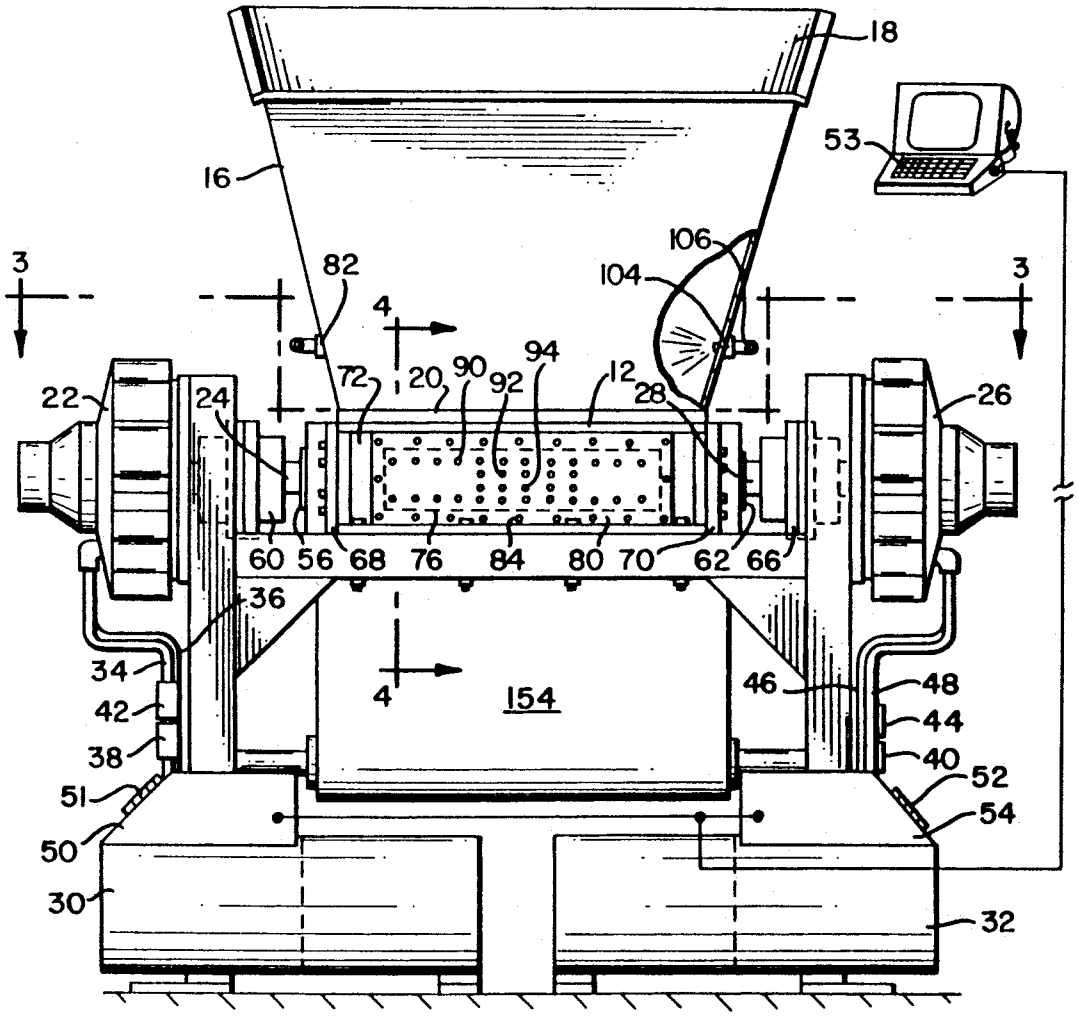
FIG. 2 is a side plan view of a shredder and hopper assembly according to the present invention.
Figure 1:
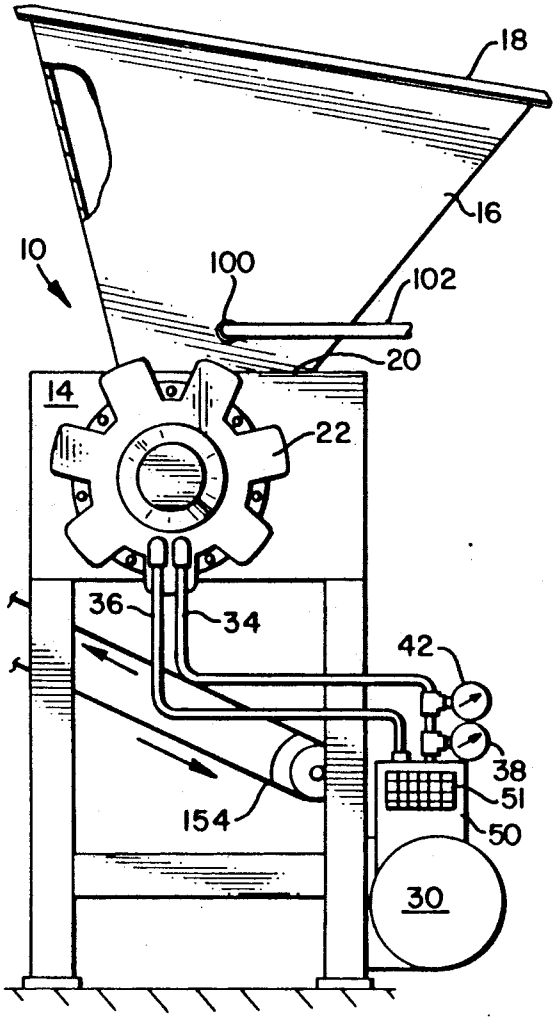
FIG. 1 is a front end plan view of a shredder and hopper assembly according to the present invention.

FIGS. 1 and 2 show a shredder assembly 10 in a side plan view and a front plan view, respectively. The shredder 10 has a shredder housing 12 held within a shredder frame 14. The plastic to be shredded is fed into the shredder housing 12 through a feed hopper 16, which may conveniently be made of sheet metal formed into an inverted truncated pyramid shape. There is a wide hopper mouth 18, which narrows down to an opening 20 into housing 12. Plastic material to be shredded may be conveniently fed into hopper mouth 18, using a conveyor belt feed system (not shown) or other conventional loading mechanism which preferably provides material to be shredded at a substantially even feed rate. The plastic material is funnelled through feed hopper 16 into the housing opening 20 for shredding a will be explained further below.

A first motor 22 is held adjacent one end of housing 12 by frame 14 and is attached for driving a first shaft 24 with a rotary motion. A second motor 26 is also advantageously held adjacent an opposite end of housing 12 by frame 14 is attached for driving a second shaft 28 which is parallel and spaced apart from first shaft 24.

Advantageously, motors 22 and 26 are adjustable speed motors which have adequate power for driving a sufficient number of blades, each with a sufficient thickness, and for shredding the large quantities of plastic into the desired sizes and at a desired high rate. Preferably, motors 22 and 26 are hydraulic motors which are driven by first and second electric motor and hydraulic pump assemblies 30 and 32, respectively. Pressurized hydraulic fluid is carried to first hydraulic motor 22 through a first input tube 34 and returned to the first pump and motor assembly 30 through a first outlet tube 36. Similarly, hydraulic motor 26 receives pressurized fluid through second input tube 46 and returns the fluid through a second outlet tube 48. The hydraulic tubing is preferably formed of reinforced high pressure hoses for ease of maintenance and assembly, but could alternatively be properly plumbed metal pipes or tubing. Radial hydraulic motors are advantageously used to provide durability in and variable speed in power ranges of about 40 to 100 horsepower. Variable speed and power is conveniently accomplished through the control of hydraulic flow rate and hydraulic pressure. About 60 horsepower has been found to be adequate for thirty-two interdigitated blades (sixteen on each shaft) of about 1½ inch thickness and a diameter of about 10 inches. A first and second control system 50 and 54, respectively, can be used for setting, monitoring and controlling the hydraulic pressure and fluid flow rate into and out of the motors to maintain an appropriate rotating speed. For example, first and second input flow and pressure sensors 38 and 40 may be interposed within hydraulic input tubing 34 and 46 as part of control system 50. Similarly, first and second outlet sensors 42 and 44 may be interposed in first and second outlet tubing 36 and 48 as part of control system 54.

Preferably, the speed of each of shafts 24 and 28 can be independently adjusted, using control systems 50 and 54, so that each shaft rotates at a desired speed. Thus, the speeds can be adjusted to be the same or slightly different in order to maximize the shearing action of the shredder, as will be more fully explained below. Rotation at slow speeds in the range of between about 1 and 30 rpm for 10 inch diameter blades is advantageous to maintain a desired flow rate yet reduce the heat buildup due to shearing of the plastic. The control systems 50 and 54 may be operated from on-site control panels 51 and 52, or alternatively, one of the control panels 51 may be interconnected with both control systems 50 and 54. Further advantageously, a control panel 53 at a remote location, which may for example be a computer control panel 53, such as a computer processing unit and keyboard, may be interconnected with both control systems 50 and 54 to monitor and control the operation of the shredder motors 22 and 26, as for example, through operation of electric motors and pumps 30 and 32.

Parallel shafts 24 and 28 are mounted in shredder housing 12 for rotation. Each shaft is held rigidly parallel and spaced apart from the other. Opposite ends of each shaft are held with first and second shaft bearings 56 and 64, respectively, spaced apart in first parallel end plate 68, and with first and second opposed shaft bearings 58 and 62, respectively, mounted in second parallel end plate 70. These bearings are preferably durable heavy duty bearings, through which the shafts can be located to prevent relative movement in both lateral and axial directions. For example, tapered roller bearings directed in opposed directions will advantageously allow the "play" in the bearings to be adjusted and also allows minor axial position adjustments between each of the shafts by tightening one bearing while loosening the other so that the shaft moves slightly in one axial direction to equalize the pressure in each of the bearings. Minute adjustability has been found to be beneficial for purposes of this inventive shredder as it allows the close spacing of counter-rotating blades to be maintained. As will be explained more fully below, the axial spacing between each blade is advantageously maintained at between 0.001" and 0.005" and preferably, at about 0.0025".

Motor 22 is coupled to shaft 24 through a first coupler 60, and motor 26 is coupled to shaft 28 through a second coupler 66. As indicated, the motors and couplers are held by vertical portions of frame 14 with the shredder housing 12 supported therebetween on horizontal frame members extending between the vertical frame portions.

Advantageously, the first side 72 of housing 12 defines a side opening 76 over which a first removable side plate 80 is fastened. Standard threaded fasteners 89 may be used for this purpose. Similarly second side 74 defines a second side opening 78 over which a second removable plate 82 is fastened (shown in FIGS. 3 and 4 with hidden lines). A removable side plate uniquely allows maintenance, such as dislodging jammed materials, inspecting blades and bearing surfaces, and the like to be performed without disassembling the entire shredder. Side plates on both sides are further advantageous to allow access to each shaft and blade set.

In order to advantageously reduce spreading or flexure between parallel shafts 24 and 28 during operation, opposed first and second side support bearings 86 and 88, respectively, are attached to the sides 72 and 74. Preferably, side support bearings 86 and 88 are aligned with openings 76 and 78, respectively. Each side support bearing is preferably rigidly and replaceably attached to side plates 80 and 82 as by using standard threaded fasteners 90. The side plates 80 and 82 are also preferably removably attached to sides 72 and 74 as indicated above. In this manner, side support bearings are removable and replaceable without removing shafts 22 and 24. The side support bearings are also advantageously adjustable using first top and bottom adjusters 92 and 94 and second top and bottom adjusters 96 and 98 on the opposed side. The details of preferred construction and adjustment of the side support bearings 86 and 88 will be explained more fully below with reference to FIGS. 4 and 6. In the preferred embodiment, there are multiple side support bearings 86 and 88 positioned to support each shaft evenly along its middle section between shaft bearings 56 and 64 and opposed shaft bearings 58 and 62.

It has been found that the large volume of input plastic material consistent with the large throughput capacity of the inventive shredder can consume a substantial amount of power (each of the motors is preferably capable of producing about 60 horsepower). In the process of shredding plastic, a substantial amount of heat is generated when the plastic is sheared. In order to maintain the temperature of the blades and the shearing process below the melting temperature of the plastic material, a first spray nozzle 100 is provided attached ahead of the input opening as, for example, at one end of hopper 16 and is supplied with a first coolant supply line 102. A second spray nozzle 104 and coolant supply line 106, as well as additional spray nozzles may also be desired to evenly cool the entire shredder. Keeping the shredder cool facilitates shredding without melting the shredded pieces back together along the sheared edges. Also, the coolant mist is preferably water which is adjusted to evaporate completely so that dirt particles may be shaken off of the shredded plastic to facilitate recycling processes. Further, melting which might entrap dirt particles at the shear edges is reduced and avoided.

Figure 3:
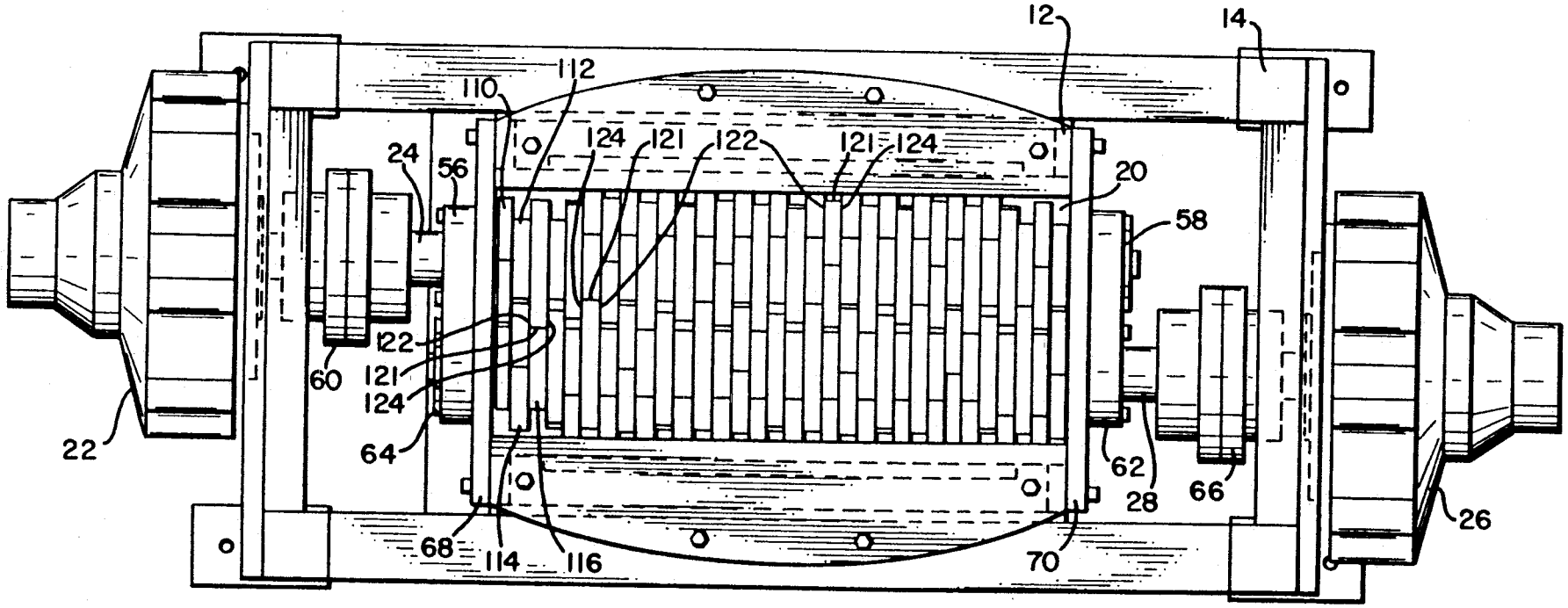
FIG. 3 is a top plan view of the shredder housing of FIG. 2 taken along line 3—3 below the hopper.
Figure 4:
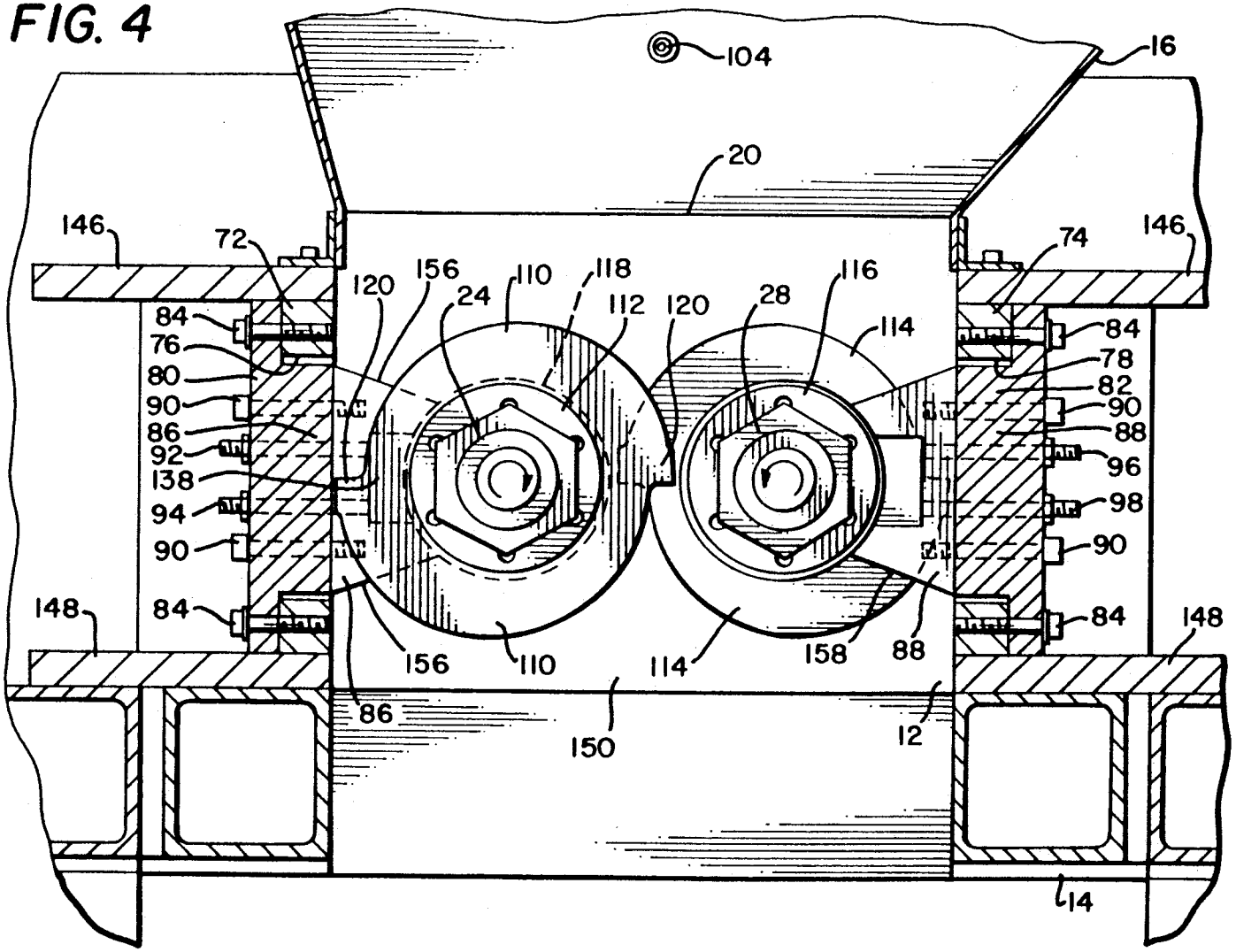
FIG. 4 is a section view through the shredder housing of FIG. 2 taken along section line 4—4.
Figure 5:
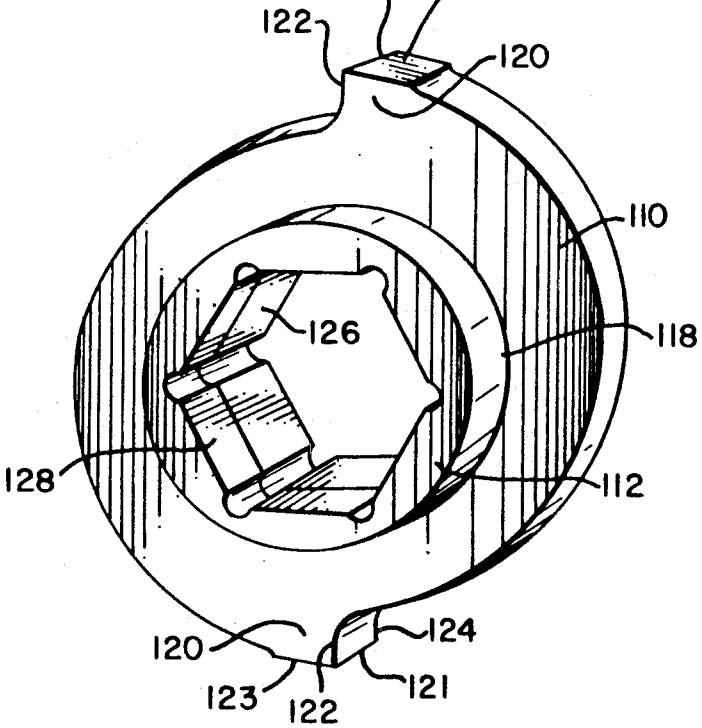
FIG. 5 is a perspective view of a cutter blade and interposed spacers providing a circular bearing surface according to the present invention.

With reference to FIGS. 3, 4, and 5, the construction and inventive arrangement of first multiple blades 110 and multiple first disk-shaped spacers 112 on first shaft 24, as well as multiple second blades 114 and multiple second disk-shaped spacers 116 on second shaft 28 are shown in a preferred embodiment.

A top plan view is shown in FIG. 3, taken along line 3—3 of FIG. 2. Multiple first blades 110 are mounted on shaft 24 within housing 12 alternatingly interspaced with first spacers 112. Each of the multiple second spacers 116 is mounted on shaft 28 opposite one of the multiple first blades 110. Multiple second blades 114 are mounted on shaft 28, each blade 114 positioned opposite a first spacer 112. Thus, blades and spacers alternate along the length of each of the shafts in an interdigitated manner. In the embodiment shown in FIG. 3, sixteen (16) pairs of blades and spacers, each approximately 1½ inches thick and having diameters of about 10 inches and 6 inches, respectively, are mounted on each of the shafts. They are alternatingly arranged for interdigitated meshing between the first blades 110 and second blades 114 so that the casing has dimensions of about 48 inches long by 16 inches wide by 10 inches deep.

With reference to FIG. 4, which is a partial cross-sectional end view taken along line 4—4 of FIG. 2, the overlapping intermeshing arrangement between blades 110 and 114 can be further understood. Further, details of blade and spacer construction will be understood with reference also to FIG. 5. For purposes of explanation, the details of construction of each of the first and second blades 110 and 114 and each of the first and second spacers 112 and 116 will be explained in connection with a perspective depiction of a single blade 110 and a single spacer 112 in the perspective view of FIG. 5. It will be understood that the construction of first blade 110 is substantially identical to second blade 114 except for mounting them on separate first and second shafts and with oppositely directed teeth 120. Similarly, first and second spacers 112 and 116 are substantially identical.

Thus, FIG. 5 shows a perspective end view of a typical blade 110 with a spacer 112. Each blade 110 and spacer 112 are disk shaped. The perimeter of blade 110 is contoured to provide one or more blade teeth 120. The perimeter of spacer 112 presents a circular or more accurately, a cylindrical bearing surface 118. Each blade 110 has a thickness 111 at its teeth 120 which is slightly less than the thickness 113 of spacer 112, so that blades 110 and 114 may rotate in an interdigitated fashion adjacent the slightly thicker spacers 112 and 116 without direct contact or rubbing between the blade teeth. Careful adjustment of the respective axial positions of the shafts maintains the first and second blades 110 and 114 closely spaced with respect to each other. The thickness of each spacer is identical and slightly thicker than the blades so that there is even spacing between side cutting edges 122 and 124 between each successive blade tooth 120. A horizontal blade cutting edge 121 is formed on each cutting blade at a maximum radius from the axis of rotation. The teeth 120 define a tapered clearance angle 123 appropriately formed for efficiently cutting the type of plastic at the cutting speed desired.

The blades are held for rotation with respect to the shafts by known indexing means 126 which may, for example, be a hexagon-shaped internal surface 126 which corresponds to similarly hexagon-shaped shafts 24 and 28. The interior 128 of spacers 112 may be similarly shaped for maximum support on shafts 24 and 28. In this preferred embodiment, the spacers rotate with the shafts without slipping therebetween so that undesirable shaft wear is avoided. The cylindrical bearing surface 118 is properly hardened and ground to a smooth surface finish to provide minimum friction and high wear resistance in connection with receiving bearing support from side support bearings 86 or 88 as the case may be for a given first or second spacer, respectively.

Figure 6:
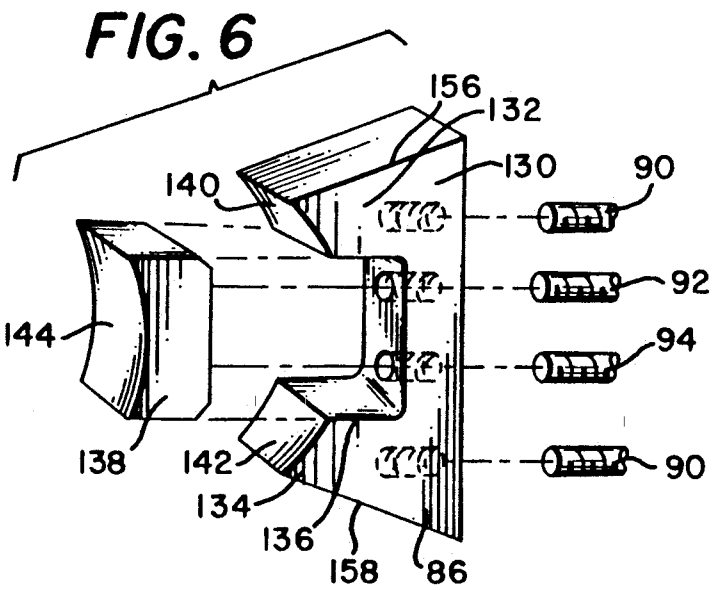
FIG. 6 is a perspective view of a side bearing jacket and adjustable replaceable bearing insert according to the present invention.

With reference to FIG. 6, the details of construction of a preferred embodiment of a side support bearing 86 can be more fully understood. It will also be understood that the construction of side support bearings 88 may be identical except that it is mounted on the opposite side and directed in the opposed direction in the shredder. Each side support bearing 86 (or 88) comprises a bracket 130 having first and second fingers 132 and 134 which define a cavity 136 therebetween. The cavity receives a bearing insert 138, which insert is positioned between fingers 132 and 134 for horizontal sliding engagement therewith. Each finger 132 and 134 has tips 140 and 142, respectively. The tips preferably define partial cylindrical concave surfaces 140 and 142, each with a radius of curvature corresponding to the cylindrical bearing surface 118 of spacers 112 and 116. Tip surfaces 140 and 142 shield the bearing insert 138 from plastic and debris. The bearing insert 138 similarly has a concave cylindrical arc surface 144 for bearing support sliding engagement with cylindrical surface 118 of spacers 112 or 116. The bearing inserts 138 may be formed of a suitable durable bearing material which provides high strength and low frictional coefficient against hardened steel spacer surface 118. It has been found that such inserts may be advantageously constructed of a material known as BARGO CN PLATE, available from Bargo Engineering, or alternatively, a material known as AMCO COPPER BRONZE, available from various material suppliers. Insert 138 is thus slidingly held in place between fingers 132 and 134 and located between alternating first blades 110 on one side and between second blades 114 on the other side. One or more of the insert(s) on each side is (are) preferably adjustable inwardly using adjusters 92 and 94 to compensate for bearing wear at surface 144. Preferably, the adjustable bearing inserts are centrally positioned at the middle of the sides so that they support each shaft at the middle along its length where shaft spreading and therefore bearing wear is greatest.

With reference again to FIGS. 3 and 4, it can be understood that the unique construction of Applicants' shredder provides multiple cutting edges at which the plastic is shredded. The close tolerance spacing of between about 0.001" and 0.005" is carefully maintained at the cutting interfaces between the cutting edges of the teeth 120 and opposed surfaces. For example, at the cutting interfaces between lateral edges 121 and opposed surfaces and bearing surface 118, close tolerance spacing is maintained by proper location of bearings 56, 58, 62 and 64. Also, through proper adjustment of side support bearing inserts 144, shafts 24 and 28 are prevented from lateral spreading due to the cutting and shearing pressure at the cutting interface between edges 121 and surfaces 118 as the blades counter-rotate with respect to each other. Further, the spacing at the cutting interface between the sides of each of the blades 110 and 114 at cutting edges 122 and 124 of each blade tooth 120 is maintained because the thickness of the blades 110 and 114 is only a few thousandths of an inch thinner than the thickness of the spacers 112 and 116 therebetween. This is particularly advantageous for shredding plastic film which is only a few thousandths of an inch or a few millimeters thick. Further, the housing 112 preferably has its sides 72 and 74 spaced apart a desired distance corresponding to the spacing required to accommodate the spacing between the axes of the two shafts 24 and 28 and the maximum radius of each of the multiple blades extending radially therefrom. This spacing is rigidly maintained through the construction of housing 12, using rigid top and bottom plates 146 and 148 which are fastened to frame support 14. The bottom opening 150 is directly below the blades to discharge shredded plastic by the force of gravity.

Close spacing between blade teeth edges 121 and the interior sides of casing 12 further facilitates cutting of thin gauge plastic, including plastic film, such as grocery bags, shrink wrap, plastic film, and the like. A conveyor 154 or other means for carrying the shredded plastic for further processing may be positioned below the shredder.

The construction and interdigitated positioning of the side support bearing brackets 86 provides additional close spaced cutting interfaces between the blade teeth 120 and edge 156 or edge 158 of bearing bracket 130, depending upon the mounting position of the brackets.

Other alterations and modifications of the invention will likewise become apparent to those of ordinary skill in the art upon reading the present disclosure, and it is intended that the scope of the invention disclosed herein by limited only by the broadest interpretation of the appended claims to which the inventors are legally entitled.

What is claimed is:

1. A shredder comprising:

(a) a shredder housing having an inside, an outside, opposed side walls, opposed end walls and a bottom portion, such that said end walls and side walls are joined together to define a top inlet opening and a bottom outlet opening;

(b) two parallel spaced apart shafts, each of said shafts horizontally aligned with each other shaft, and each shaft rotationally mounted through said end walls and for receiving rotational power;

(c) adjustable speed rotational motors engaged with each of said shafts for rotating said shafts in counter-rotational directions;

(d) a plurality of uniform thickness disk-shaped blades having at least one tooth positioned peripherally around each blade and alternatingly interposed disk-shaped spacers having a thickness slightly thicker than said blades, said blades and spacers arranged on said shafts and mounted for counter-rotation with said shafts in an interdigitated fashion so that said blades on one of said shafts are aligned with said spacers on the other shaft such that said teeth on said blades pass side-by-side closely spaced with blades on said counter-rotating shaft so that cutting occurs between the teeth on one blade and the sides of said other blades;

(e) a cylindrical exterior bearing surface around the periphery of each spacer; and (f) adjustable side support bearings spaced centrally located along said opposed side walls of said inside of said shredder housing sized corresponding to the thickness of said disk-shaped spacers for sliding bearing engagement against said cylindrical bearing surface and arranged along each of said opposed side walls horizontally aligned and sized for bearing against cylindrical surfaces of said alternating disk-shaped spacers on each of said counter-rotating shafts so that said side bearings are interposed between said rotating disk-shaped cutting blades in each direction and provide bearing support to prevent shaft spreading during shredding operation.

2. A shredder as in claim 1 wherein said adjustable side support bearings further comprise:

a hardened steel bearing bracket having upper and lower fingers with inwardly facing tips having concave cylindrical arc-shaped surfaces, said fingers defining a cavity therebetween;

a bearing insert sized for sliding engagement within said cavity defined between said upper and lower fingers of the bearing bracket, said bearing insert having an inwardly facing concave cylindrical arc surface corresponding in size and shape to said peripheral cylindrical bearing surfaces of said disk-shaped spacers; and means for adjustably moving said bearing insert with respect to said spacer exterior surface for bearing contact therebetween, which means is operable from outside of said shredder housing.

3. A shredder comprising:

(a) a shredder housing having an inside, an outside, opposed side walls, opposed end walls and a bottom portion, such that said end walls and side walls are joined together to define a top inlet opening and a bottom outlet opening;

(b) two parallel spaced apart shafts, each of said shafts horizontally aligned with each other shaft, and each shaft rotationally mounted through said end walls and for receiving rotational power;

(c) adjustable speed rotational motors engaged with each of said shafts for rotating said shafts in counter-rotational directions, said adjustable speed rotational motors comprising two separate hydraulic motors, two hydraulic fluid supplies having separately controlled fluid pressure, each of said two separate hydraulic motors separately receiving pressurized hydraulic fluid from a separate one of said separate fluid supplies; and (d) a plurality of uniform thickness disk-shaped blades having at least one tooth positioned peripherally around each blade and alternatingly interposed disk-shaped spacers having a thickness slightly thicker than said blades, said blades and spacers arranged on said shafts and mounted for counter-rotation with said shafts in an interdigitated fashion so that said blades on one of said shafts are aligned with said spacers on the other shaft such that said teeth on said blades pass side-by-side closely spaced with blades on said counter-rotating shaft so that cutting occurs between the teeth on one blade and the sides of said other blades.

4. A shredder as in claim 3 wherein said separate hydraulic fluid supplies further comprise:

control circuitry; and an operator input panel by which said control circuitry can be adjusted so that each of said adjustable speed motors rotates in opposite directions with respect to each other at adjustably different rotational speeds.

5. A shredder as in claim 4 wherein said operator control panel is at a remote location from said shredder.

6. A shredder as in claim 4 wherein said control circuitry further comprises:

an automatic pressure sensor operably connected during shredder rotation; and a timing circuit responsive to said pressure sensor for reversing the direction of rotation of each of the hydraulic motors when said pressure is sensed above a predetermined level for a short period of time and for reinstituting shredder rotation automatically after said predetermined period of reverse rotation.

7. A shredder as in claim 6 wherein said automatic control circuitry further includes circuitry for reversing and restarting the shaft rotation a predetermined number of times within a predetermined time period and for shutting down the shredder if the number of reversals and restarts exceed said predetermined number during said predetermined time period.

8. A shredder comprising:

(a) a shredder housing having an inside, an outside, opposed side walls, opposed end walls and a bottom portion, such that said end walls and side walls are joined together to define a top inlet opening and a bottom outlet opening;

(b) two parallel spaced apart shafts, each of said shafts horizontally aligned with each other shaft, and each shaft rotationally mounted through said end walls and for receiving rotational power;

(c) adjustable speed rotational motors engaged with each of said shafts for rotating said shafts in counter-rotational directions;

(d) a plurality of uniform thickness disk-shaped blades having at least one tooth positioned peripherally around each blade and alternatingly interposed disk-shaped spacers having a thickness slightly thicker than said blades, said blades and spacers arranged on said shafts and mounted for counter-rotation with said shafts in an interdigitated fashion so that said blades on one of said shafts are aligned with said spacers on the other shaft such that said teeth on said blades pass side-by-side closely spaced with blades on said counter-rotating shaft so that cutting occurs between the teeth on one blade and the sides of said other blades;

(e) a cylindrical exterior bearing surface around the periphery of each spacer;

(f) adjustable side support bearings spaced centrally located along said opposed side walls of said inside of said shredder housing sized corresponding to the thickness of said disk-shaped spacers for sliding bearing engagement against said cylindrical bearing surface and arranged along each of said opposed side walls horizontally aligned and sized for bearing against cylindrical surfaces of said alternating disk-shaped spacers on each of said counter-rotating shafts so that said side bearings are interposed between said rotating disk-shaped cutting blades in each direction and provide bearing support to prevent shaft spreading during shredding operation; and (g) a temperature sensor directed to the interior of the shredder housing, operatively connected to said coolant supply means to automatically adjustably deliver an amount of coolant spray sufficient to maintain the shredding temperature below said melting point of the plastic to be shredded.

9. A shredder comprising:

(a) a shredder housing having an inside, an outside, opposed side walls, opposed end walls and a bottom portion, such that said end walls and side walls are joined together to define a top inlet opening and a bottom outlet opening;

(b) two parallel spaced apart shafts, each of said shafts horizontally aligned with each other shaft, and each shaft rotationally mounted through said end walls and for receiving rotational power;

(c) adjustable speed rotational motors engaged with each of said shafts for rotating said shafts in counter-rotational directions;

(d) a plurality of uniform thickness disk-shaped blades having at least one tooth positioned peripherally around each blade and alternatingly interposed disk-shaped spacers having a thickness slightly thicker than said blades, said blades and spacers arranged on said shafts and mounted for counter-rotation with said shafts in an interdigitated fashion so that said blades on one of said shafts are aligned with said spacers on the other shaft such that said teeth on said blades pass side-by-side closely spaced with blades on said counter-rotating shaft so that cutting occurs between the teeth on one blade and the sides of said other blades;

(e) a closable opening in said side of said housing; and (f) said cover plate sized for removably closing said closable opening in said housing side, so that the interior of said housing may be accessed by an operator without removing said parallel shafts and (g) side support bearings replaceably attached to said removable cover plate, so that said side support bearings can be replaced without removing said parallel shafts.

10. A shredder wherein:

(a) a close tolerance shredder housing having an interior and an exterior, said interior defined by close tolerance side walls, axially opposed substantially parallel close tolerance end walls connected to said side walls to define a top inlet opening, and a bottom outlet opening;

(b) first and second parallel spaced apart shafts, each shaft horizontally aligned with each other shaft, and each shaft rotationally mounted at said end walls for receiving rotational power therethrough;

(c) rotational motors coupled with each of said shafts for rotating each of said shafts in counter-rotational directions;

(d) a series of uniform thickness disk-shaped blades and alternatingly interposed uniform thickness disk-shaped spacers having circular bearing surfaces arranged on each counter-rotating shafts in an interdigitated fashion so that said blades on one of said first and second shafts are aligned with said spacer bearing surfaces on another of said first and second shafts, said series of uniform thickness disk-shaped blades comprise multiple blades each having a predetermined thickness and said uniform thickness disk-shaped spacers comprise multiple spacers each having a thickness between about 0.002" and 0.010" greater than said predetermined thickness of said blade and (e) a removable hatch formed in said shredder housing side walls for removable access to said interior of said shredder housing without removal of said shafts, blades, or spacers.

11. A plastic shredding device comprising:

(a) a housing;

(b) two parallel spaced apart shafts;

(c) rotational motors engaged with each of said shafts for rotating said shafts in counter-rotational directions;

(d) a plurality of disk-shaped blades positioned along a length of each of said parallel shafts for closely spaced counter-rotation in an interdigitated fashion such that each blade on each shaft passes side by side a blade on the counter-rotating shaft; and (e) means for automatically sensing the torque on said counter-rotating shafts for automatically reversing and restarting the rotation of the shafts upon sensing a high torque above a predetermined torque so clogging which causes said high torque can be automatically disengaged by said reversed and restarted rotation, said means for automatically reversing and restarting the rotation of said rotating shafts upon sensing a predetermined high torque further comprising means for automatically reversing and restarting in response to a predetermined number of times a high torque is sensed during a predetermined short time period and for automatically shutting off the shredding device if a number of times said high torque is sensed exceeds said predetermined number.

12. A shredder as in claim 1 wherein said adjustable side support bearings further comprise:

a bearing jacket;

a bearing insert held slidably positionable and within said bearing jacket; and adjustment means extending through said bearing jacket and said removable cover plates for adjusting said position of said bearing insert without removing said removable cover plates.

* * * * *